United States Patent [19]

Vornberger

[11] Patent Number: 4,553,281

[45] Date of Patent: Nov. 19, 1985

[54] SIDE AND HEEL LASTING MACHINE

[75] Inventor: Karl F. Vornberger, Amherst, N.H.

[73] Assignee: International Shoe Machine Corporation, Nashua, N.H.

[21] Appl. No.: 612,481

[22] Filed: May 21, 1984

[51] Int. Cl.[4] ..... A43D 21/00

[52] U.S. Cl. ..... 12/8.1; 12/10.5; 12/12

[58] Field of Search ..... 12/12, 12.5, 14.3, 8.1, 12/8.2, 8.3, 10, 10.5, 10.8, 145

[56] References Cited

U.S. PATENT DOCUMENTS

| | | | |
|---|---|---|---|
| Re. 29,120 | 1/1977 | Vornberger | 12/10.5 |
| 3,292,190 | 12/1966 | Kneeland | 12/8.1 |
| 3,775,797 | 12/1973 | Kamborian et al. | 12/8.1 |
| 4,082,060 | 4/1978 | Vornberger et al. | 12/10.5 |

*Primary Examiner*—Werner H. Schroeder
*Assistant Examiner*—Steven N. Meyers
*Attorney, Agent, or Firm*—Robert Shaw

[57] ABSTRACT

A side and heel lasting machine. The machine serves to adhere the unwiped margin of a shoe upper assembly, whose toe portion has been wiped, to the periphery region of the assembly insole. Lasting pads are employed to keep the margin in position during application of adhesive from nozzles that are spring loaded to press outwardly and track the upstanding margin when adhesive is applied in the region between the insole and the margin. The pads are then raised and urged inwardly to press the margin onto the insole. The top edge of inner lasting pads are folded onto the insole to achieve during wiping action; the direction of forces upon the top edges of the lasting pads is changed during wiping to increase downward wiping forces upon the margin. A quick-release mechanism is provided to permit removal and replacement of the lasting pads without need to remove any screw-type fasteners.

16 Claims, 15 Drawing Figures

SIDE AND HEEL LASTING MACHINE

The present invention relates to machines to last the sides and heel of a shoe or other footwear assembly.

Attention is called to U.S. Pat. No. Re. 30,646 (Vornberger et al) and the further art cited in that patent.

Hereinafter the invention is described mostly in the context of a lasting machine for shoes. In the typical shoe fabrication process, as is discussed in great detail in the Vornberger et al patent, a shoe upper assembly, formed of a last having an insole located on its bottom and an upper mounted thereon, is first toe lasted and then side and heel lasted. Typically in the toe lasting operation the upper margin is adhered to the insole from the toe to the ball portion of the assembly; then the upper margin extending heelwardly from the wiped portion is cemented onto the insole. It is the latter operation that is performed on the machine herein disclosed and is called side and heel lasting. Typically, in the present-type machine, an adhesive is applied as a liquid ribbon in the region of the insole near its periphery or edge, or, in some machines, onto the upwardly directed margin by nozzles which track the upwardly directed margin during application of the adhesive. The nozzles are spring loaded (typically by an air spring) to press outwardly against the upper margin and to track that margin. Lasting is achieved by the wiping action of a lasting tool which presses the upper margin inwardly and downwardly upon the insole, squeezing the adhesive therebetween to adhere the margin onto the insole.

It is an objective of the present invention to provide a machine whose lasting tool permits application of even greater downward pressure then heretofore available in the adhering step of lasting while nevertheless applying appropriate force and direction upon the margin during application of adhesive.

Another objective is to provide a machine in which the lasting tool provides appropriate backup pressure during the application of the adhesive to permit application of the adhesive as a ribbon in a desired region between unwiped margin portions and corresponding portions in the vicinity of the insole periphery.

The lasting tool is the present machine typically includes a plurality of lasting pads which are made of a plastic material that can take different shapes to accommodate different shoe sizes and shapes. It has been the practice to attach the pads to the other parts of the lasting tool with machine screws at opposite (i.e., upper and lower) edges of all the pads requiring time consuming replacement activities. It is another, and important, objective to provide a quick-release mechanism to permit fast removal of the lasting pads and replacement thereof without need to remove any screw-type fasteners.

The lasting pads, as later discussed, have forces applied to their upper edges by drivers that force the pads toward the upper assembly in the course of the lasting operation. It has been found, for present purposes, that forces should be applied perpendicular to the upper at the point of contact between the particular lasting pad and the upper assembly.

Still another objective is to provide a way to permit both horizontal and vertical adjustments of the drivers to permit them to assume positions that furnish the forces in the perpendicular direction.

These and still further objectives are addressed hereinafter.

The foregoing objectives are attained, generally, in a machine, operable on a footwear assembly having an insole located at its bottom and an upper mounted thereon with the toe portion of the upper margin wiped against and secured to the insole and unwiped portions of the upper extending heelwardly of the wiped margin portion, which unwiped margin portions extend upwardly at an open angle to the insole, for applying adhesive in the region between said unwiped margin portions and the corresponding portions of the insole at said region. The machine includes a footwear assembly support for supporting the footwear assembly with the insole directed upwards; a pair of nozzles spaced outwardly from and facing said insole and mounted for motion toward and away from the insole as well as transverse and longitudinal movement with respect to the insole, said nozzles being operable to apply adhesive into said region; a lasting tool operable to clamp the upper tightly against the last and to apply light backup pressure against the unwiped margin to support the same, but nevertheless maintaining the open angle between the unwiped margin portions and the insole, said lasting tool comprising two lasting instrumentalities each comprising two inner lasting pads, one inner lasting pad being disposed at each side of the footwear assembly, each lasting pad being made of an elastic, flexible and deformable material, one end of each inner lasting pad being formed into a plurality of relatively rigid segments; actuator means to press the inner lasting pad at each side of the footwear assembly inwardly of the footwear assembly to press the upper tightly against the last and to apply said light backup pressure while maintaining said open angle, which actuator means presents the two inner lasting pads at one level when the adhesive is being applied and, subsequent to application to the adhesive, moves the two lasting instrumentalities to a second level upwardly of said insole while simultaneously moving the relatively rigid segments of the two inner lasting pads inwardly and over the insole to press the adhesive between the margin and the insole to adhere the margin onto the insole, part of said actuator means being pivoted during wiping from an orientation at which forces upon the pads are directed at a small acute angle to the footwear assembly bottom to an orientation at which the forces are at a much larger acute angle to the footwear assembly bottom to provide a much greater downward component of force upon the cement margin. In preferred form of the machine the two lasting instrumentalities include quick-release mechanisms to permit fast removal of the lasting pads and replacement thereof without need to remove any screw-type fasteners.

The invention is hereinafter described with reference to the accompanying drawing in which.

Figure 1:
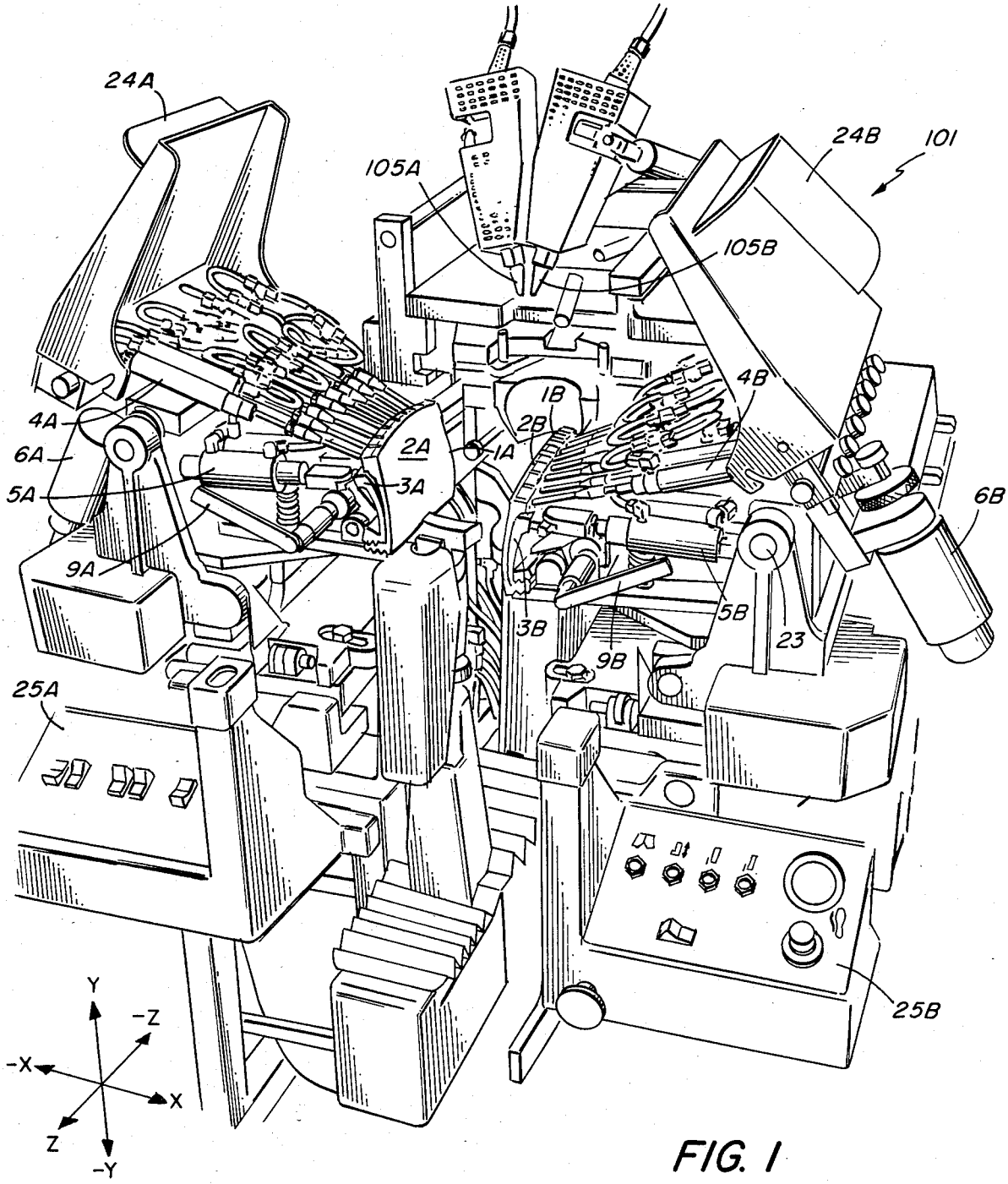
FIG. 1 is an isometric view of a machine that embodies the present invention, looking downward on the machine from the front thereof and slightly to the right of its center to show, among other things, lasting pads and air-actuated cylinders to press the lasting pads onto a shoe upper during lasting.

The operator is intended to stand in front of the machine labeled 101 in FIG. 1 looking in the minus Z direction. Directions extending toward the operator (i.e., plus Z direction) will be designated as "forward" and directions extending away from the operator will be designated as "rearward". The front of the machine is closest to the operator and the back of the machine is furthermost from the operator.

The machine 101 is operable on a footwear assembly 102 (FIGS. 11A, 11B, 11C and 12) that includes a last 106 having an insole 103 located at its bottom and an upper 104 mounted thereon with the toe portion 107 of the upper margin wiped against and secured to the insole. The unwiped margin portions marked 107A and 107B of the upper extending heelwardly of the wiped margin portion extend upwardly at an open angle A (FIG. 11A) to the insole. Nozzles 105A and 105B (FIG. 1; the right nozzle only as shown in FIG. 11A to permit better showing of the open angle A) apply adhesive as a liquid ribbon in corner region marked 111 in FIG. 11A between the unwiped margin portion and the corresponding portions of the insole periphery, that is, adhesive is applied onto the insole near its periphery or adhesive is applied onto the upstanding unwiped margin in the vicinity and above the insole periphery. Then, as later discussed, the upstanding unwiped margin is pressed down onto the insole squeezing the adhesive therebetween to adhere the margin to the insole. In order that the adhesive be correctly placed over the whole length of the unwiped margin portion, the nozzles 105A and 105B are spring loaded to press outwardly against the margin and track the margin as they move rearwardly from the ball of the upper assembly, along the sides thereof and thence to the heel. The nozzles 105A and 105B are initially spaced upwardly from and facing the insole 103; they are mounted for motion toward and away from the insole (±Y-direction in FIG. 1) as well as transverse (±X-direction) and longitudinal (±Z-direction) movement with respect to the insole.

Figure 11C:
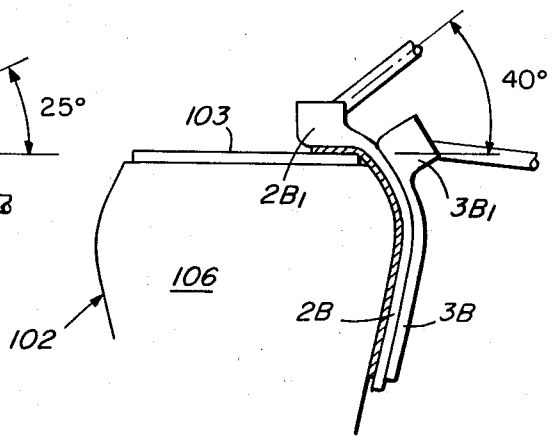
FIGS. 11A, 11B and 11C are section views showing a footwear assembly having adhesive applied thereto and then being lasted (FIGS. 11B and 11C)
Figure 11B:
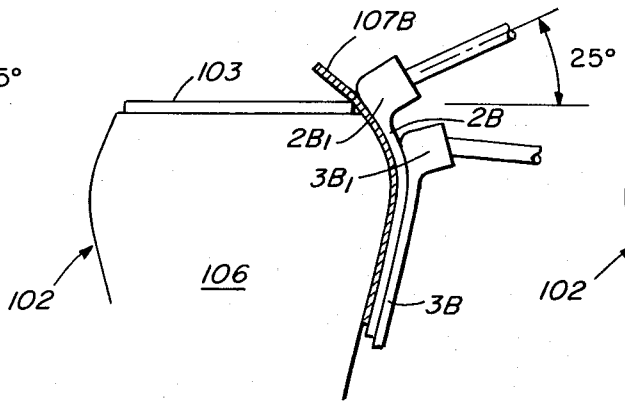
Figure 11A:
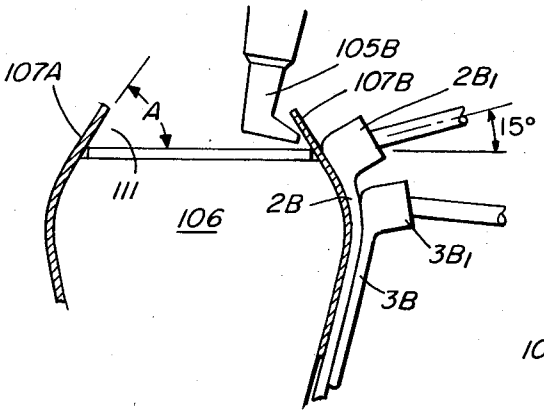

The machine 101 includes a lasting tool operable to clamp the upper 104 against the last 106 in FIGS. 11A–11C and to apply light backup pressure against the unwiped margins 107A and 107B to support the same, but nevertheless maintain the open angle A between the unwiped margin portion 107A and 107B and the insole to permit application of adhesive into the region between the unwiped margin portion and the corresponding adjacent portion of the insole. The lasting tool includes two lasting instrumentalities 1A and 1B (FIG. 1) each consisting, in the disclosed embodiments, of an inner lasting pad 2A and 2B, respectively, and an outer lasting pad 3A and 3B, respectively. Each lasting pad is made of an elastic, flexible and deformable material such as urethane. The upper end of each inner lasting pad is formed into a plurality of relatively rigid segments marked $2A_1$ and $2B_1$ for the pads 2A and 2B, respectively. The upper rigid segments of the outer pads 3A and 3B are marked $3A_1$ and $3B_1$ respectively. As later described in detail, an actuator mechanism presses the relatively rigid segments $2A_1$, $2B_1$, $3A_1$ and $3B_1$ at each side of the footwear assembly 102 inwardly of the footwear assembly to press the upper tightly against the last 106 and to apply the light backup pressure while maintaining the open angle A (FIG. 11A). The actuator mechanism presents the lasting pads at one (i.e., lower) level (FIG. 11) when the adhesive is being applied and, subsequent to application of the adhesive, moves the two lasting instrumentalities 1A and 1B to a second (i.e., higher) level upwardly (FIGS. 11B and 11C) of the insole while simultaneously moving the rigid segments of the two inner lasting pads inwardly and over the insole in a wiping action to fold the margin onto the insole to press the adhesive between the margin and the insole to adhere the margin onto the insole, as shown in FIG. 11C. The combined upward movement and inward wiping action of the instrumentalities 1A and 1B serve, among other things, to stretch the upper 104 about the last 106. The actuator mechanism, as later discussed, employs a wedge and wheel arrangement which gives steady and controllable upward forces to move the pads between the two levels. At the lower level (FIG. 11A) during application of adhesive the pads are less likely to fold the margin onto the insole. The inwardly directed forces are applied by air-actuated finger cylinders 4A and 4B upon the inner pads 2A and 2B and air-actuated cylinders 5A and 5B upon the outer pads 3A and 3B. The finger cylinders have a further action as now explained.

Figure 8:
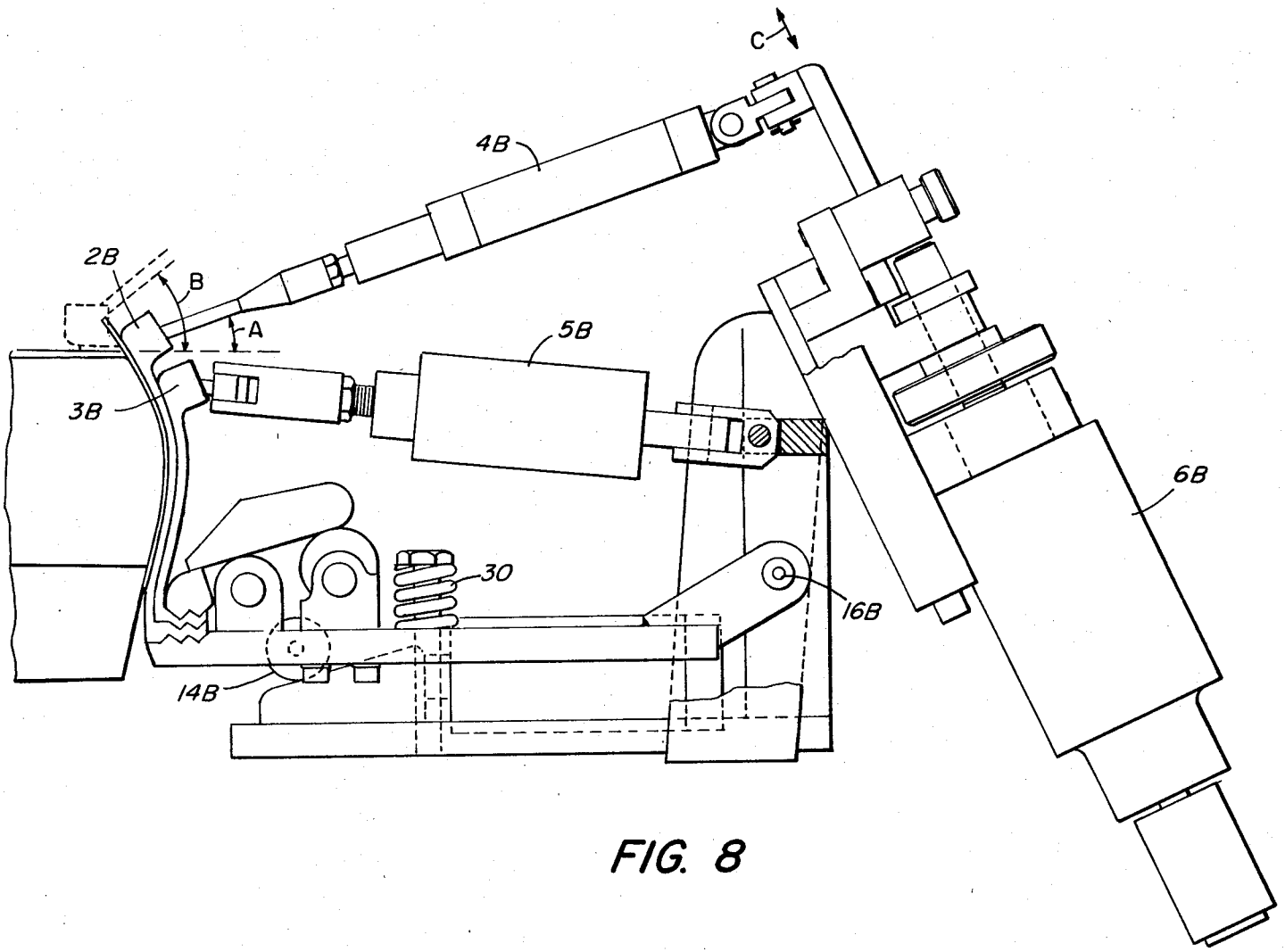
FIG. 8 is a front view showing inner and outer right lasting pads of the machine of FIG. 1, together with their associated air-actuated cylinders and showing a scheme to permit tilting of the upper set of cylinders.

During the wiping action the finger cylinders 4A and 4B of the actuator mechanism not only move upwardly. They also pivot from an orientation at which inward forces upon the associated pads is directed at a small acute angle to the shoe assembly bottoms (see the 15 degree angle in FIG. 11A) which helps to maintain the open angle A between the margin and the insole, to an orientation at which the forces are at a much larger acute angle (see the 25 degree angle and 40 degree angle in FIGS. 11B and 11C respectively) to the shoe assembly bottom, thereby to provide a much greater downward component of force upon the lasting margin. The pivoting action just explained is effected by an air-actuated cylinder 6B in FIG. 8 with respect to the cylinders 4B (a similar cylinder at the left side of the machine 101 in FIG. 1 pivots the cylinders 4A).

Figure 2:
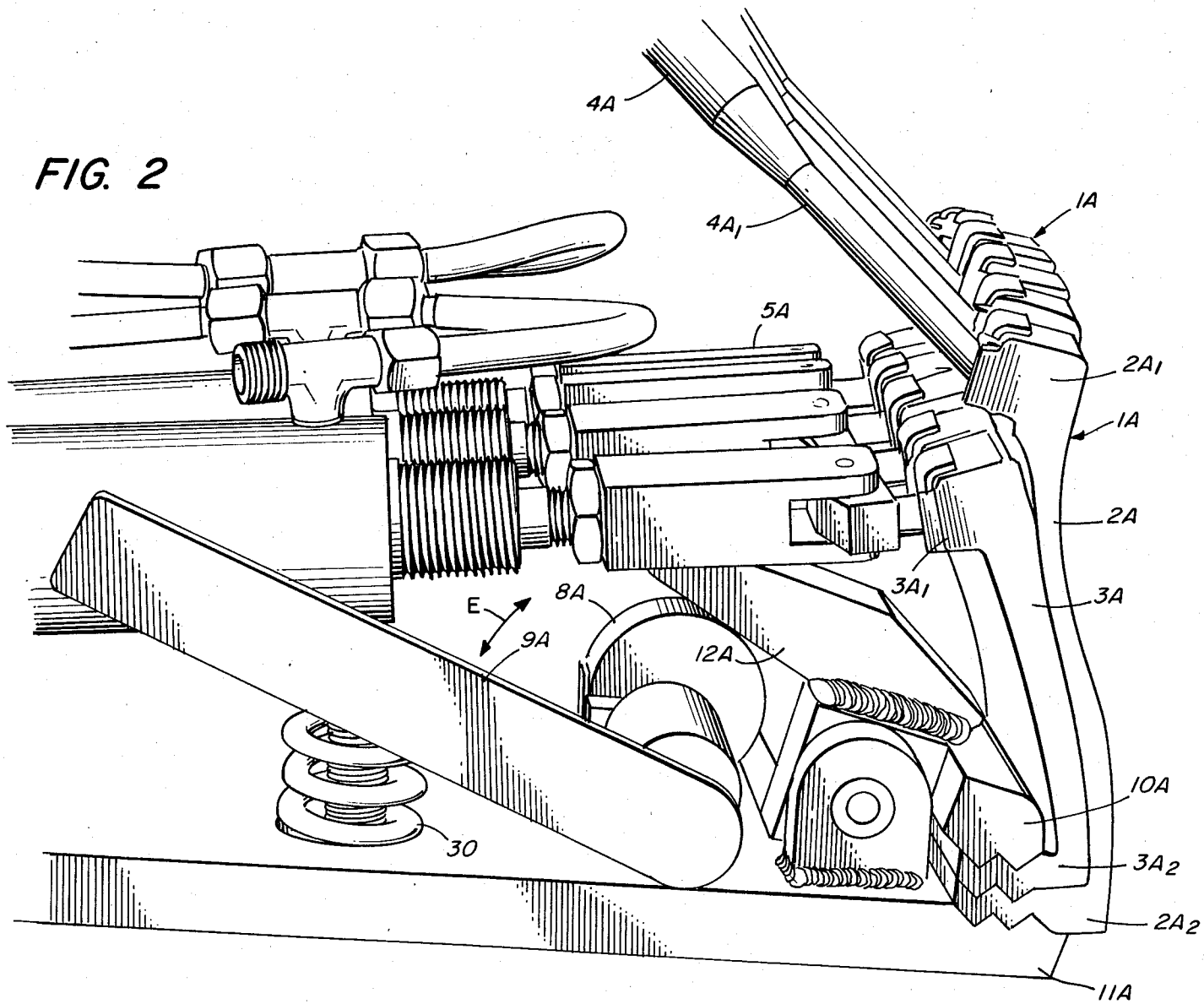
FIG. 2 is an isometric view of the left lasting pads (and closely associated parts) in FIG. 1 to show some details of a quick-release mechanism whereby the lasting pads are attached to the machine without use of screw-type fasteners.
Figure 3:
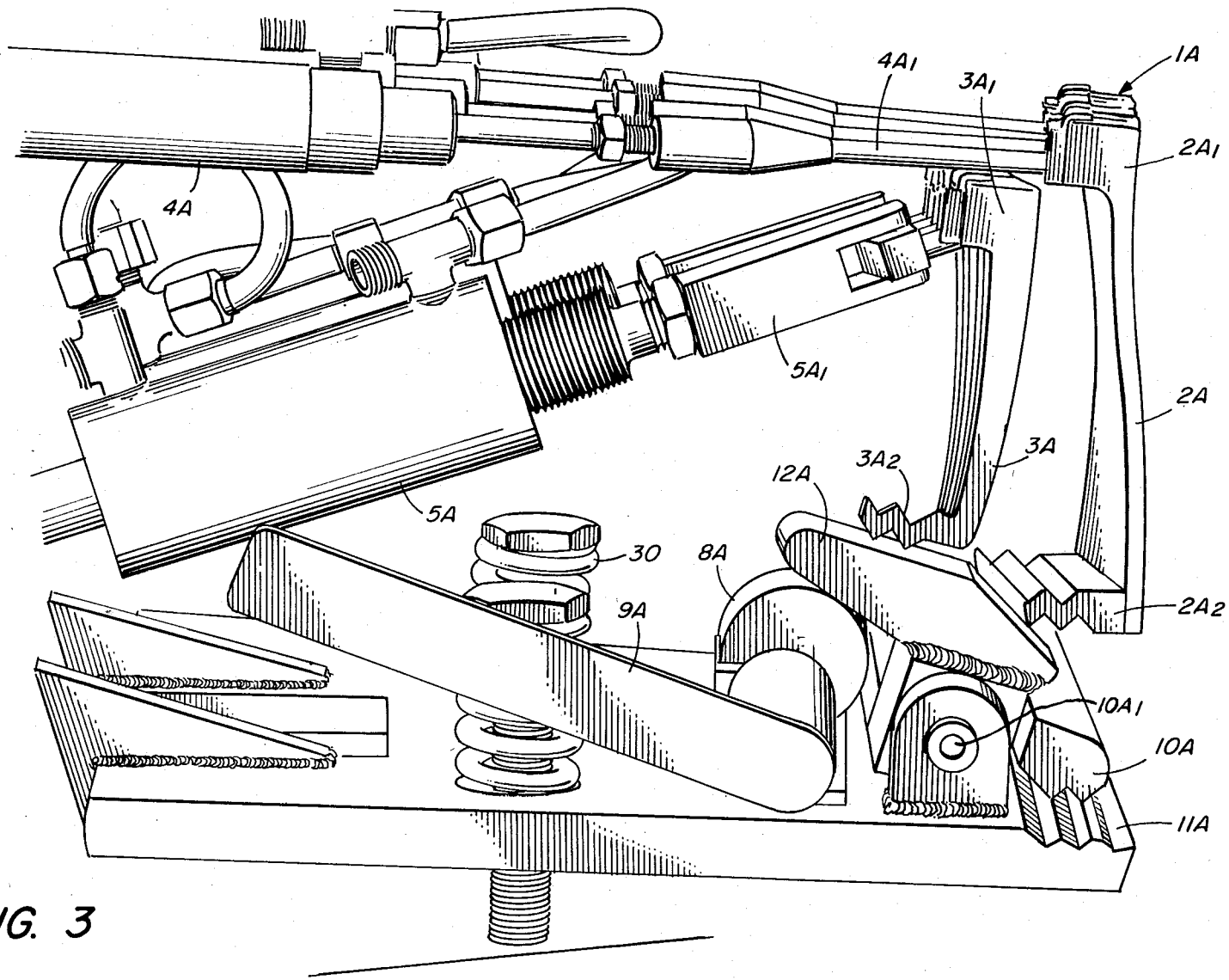
FIG. 3 is an isometric view of the pads of FIG. 2 with their lower ends released from attachment to the machine.
Figure 4:
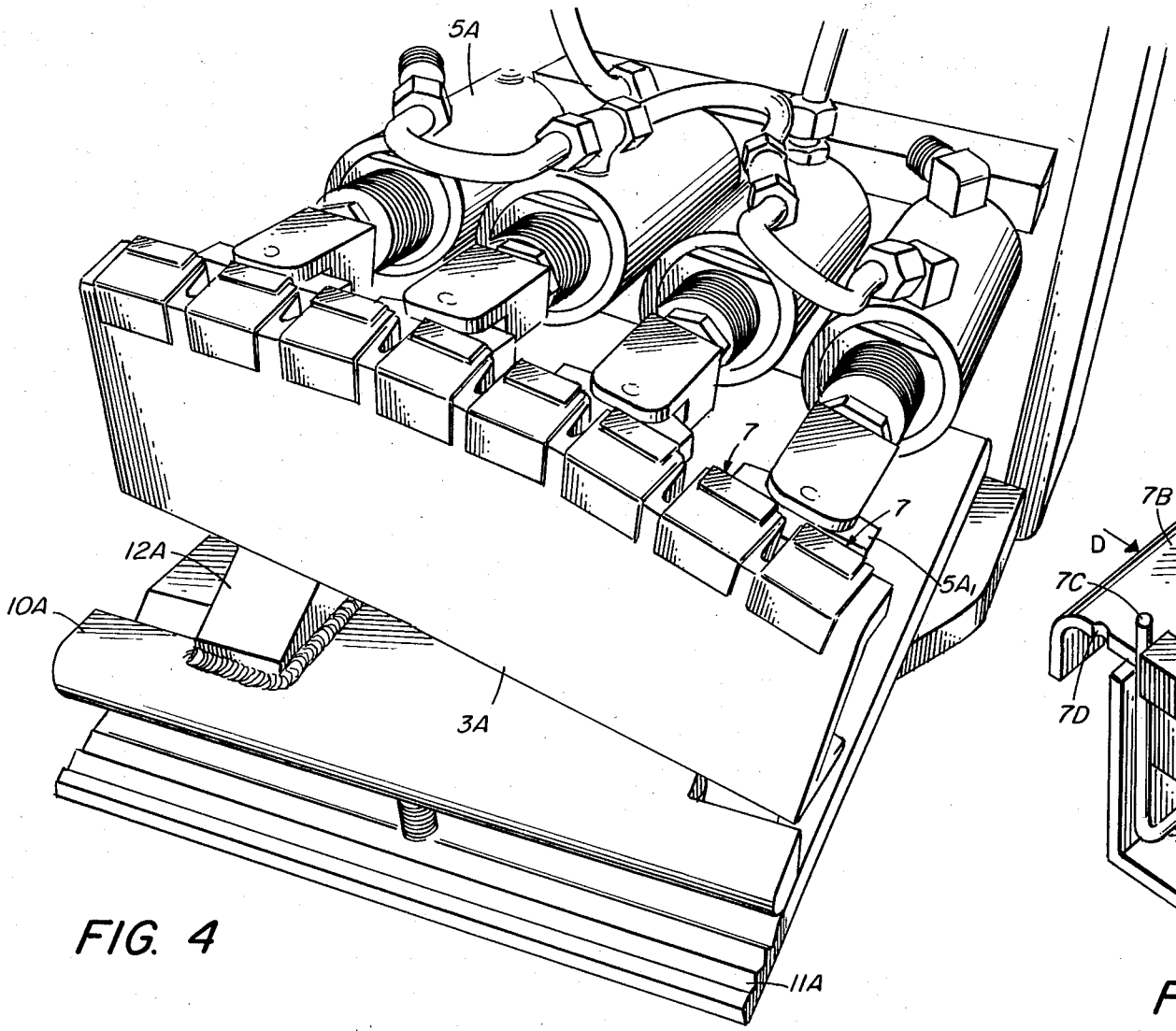
FIG. 4 is an isometric view of one of the lasting pads of FIG. 2 looking down from the right upon the working face of the outer of the two pads.

An important aspect of the present invention is providing a quick-release mechanism to permit fast removal and replacement of the pads 2A, 2B, 3A and 3B without need to remove any screw-type fasteners. The discussion that now follows if mostly with regard to the left lasting instrumentality 1A (FIG. 1) in FIGS. 2, 3 and 4 and the clip shown in FIG. 5, it being noted that the description applies as well to the right lasting instrumentality 1B in FIG. 1, as well.

Figure 5:
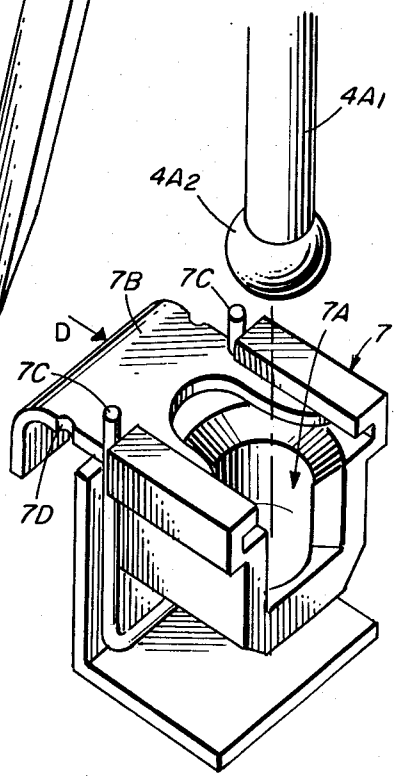
FIG. 5 shows an isometric view of a single clip of a plurality of such clips that are used to attach the upper end of each lasting pad to the machine by screwless, quick release mechanisms.

Each of the rigid segments $2A_1$, $3A_1$, $2B_1$ and $3B_1$ is formed by enlarging the upper edge of the associated pad and molding therein a metal clip fastener 7 (FIG. 5). Each fluid-actuated finger cylinder 4A has a rod $4A_1$ with a spheroidal end $4A_2$. The metal clip fastener 7 has an opening 7A to receive the spheroidal end $4A_2$ and a latch 7B to permit the spheroidal end to enter the clip when the latch is open, as it is in FIG. 5, and to retain the spheroidal end therein when the latch is in the closed position which occurs when the latch 7B is moved in the direction of the arrow labeled D. A spring 7C engages slots (e.g., the slot marked 7D) to retain the latch in the open position, as in FIG. 5, or the closed position. To remove the rod $4A_1$, all that need be done is pry the latch toward the left in FIG. 5; to lock the rod $4A_1$ in place requires only pressing down with your thumb to urge the latch 7B in the direction of the arrow D. When in position, the rod $4A_1$ is universally movable through fairly large angles to permit application of properly directed forces for the purposes discussed herein.

The lower end of each of the pads 2A, 2B, 3A and 3B is received by a clamping mechanism which is operated by an eccentric cam 8A, forces being applied through a handle 9A that moves in the direction indicated by the arrows labeled E, rotating the cam 8A which engages an extension 12A of a serrated jaw 10A causing the jaw 10A to rotate about a pivot $10A_1$. The lower edges designated $2A_2$ and $3A_2$ are serrated and are pressed between the serrated member 10A and a machine base serrated member 11A when the handle 9A is moved counterclockwise in FIG. 2; release (see FIG. 3) is effected by rotating the handle 9A clockwise. The right side of the machine in FIG. 1 is the mirror image of the left side; see, for example, the handle labeled 9B which is like the handle 9A.

Figure 7:
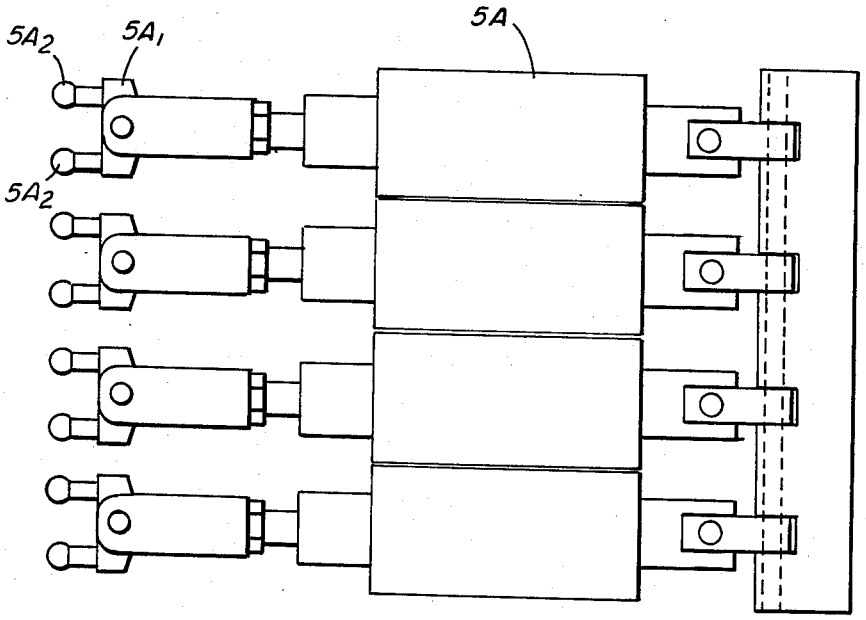
FIG. 7 is a plan view of one set of air-actuated cylinders in FIG. 1 that press an outer lasting pad toward the shoe upper.

All of the cylinders 4A, 4B, 5A and 5B are double acting, that is, air pressure forces them in both outgoing movement and incoming movement. The end $5A_1$ (FIG. 7) of the cylinder 5A has two spheroidal ends $5_2$ just like the end $4A_2$ and there are two clips fasteners 7 associated with each cylinder (see FIG. 4 where the fasteners are again marked 7). Release and replacement is achieved in the manner described above.

Figure 10A:
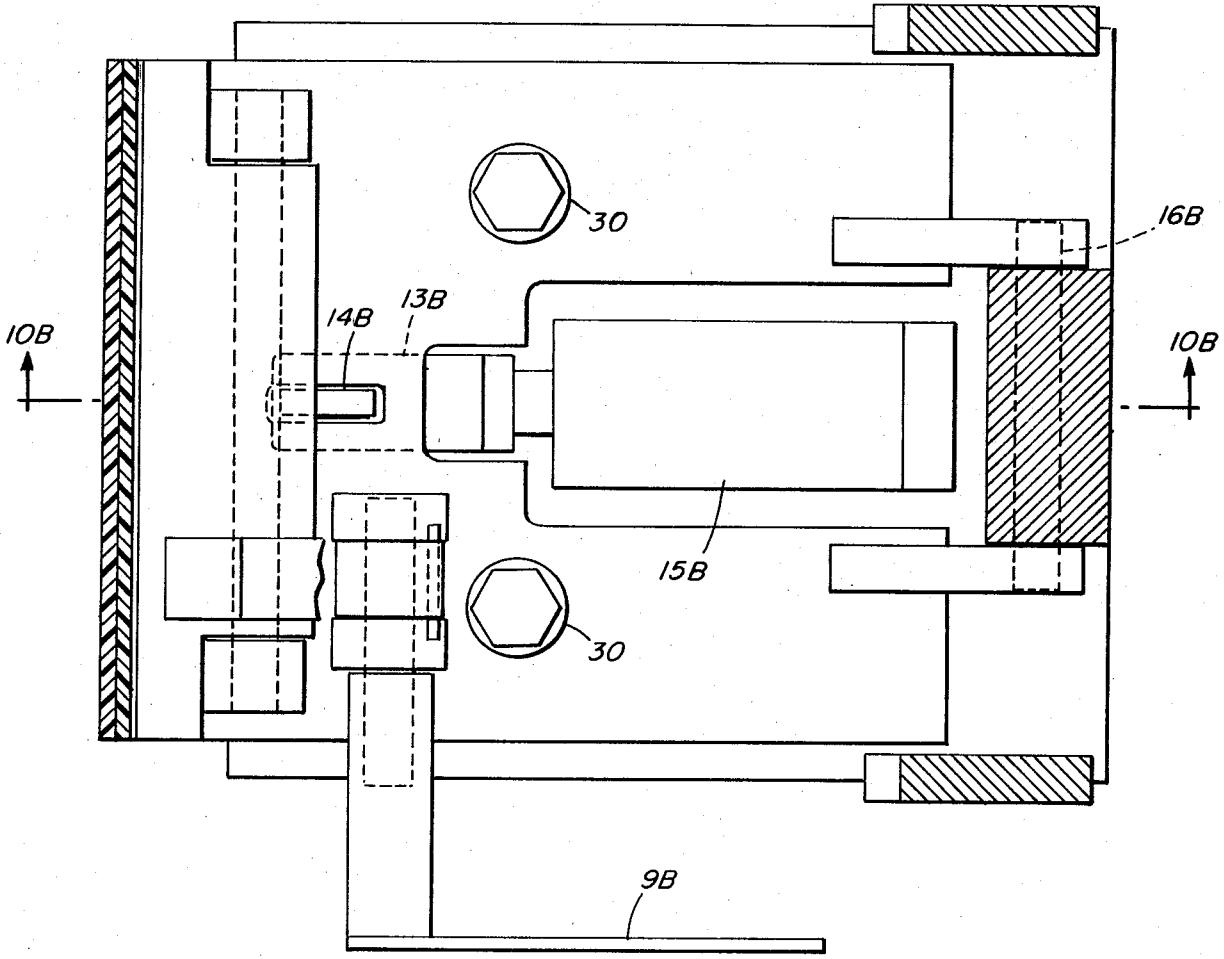
FIG. 10A is a plan view of a wedge-actuated mechanism to raise and lower the lasting pads in FIG. 1 at various stages in the lasting process.
Figure 10B:
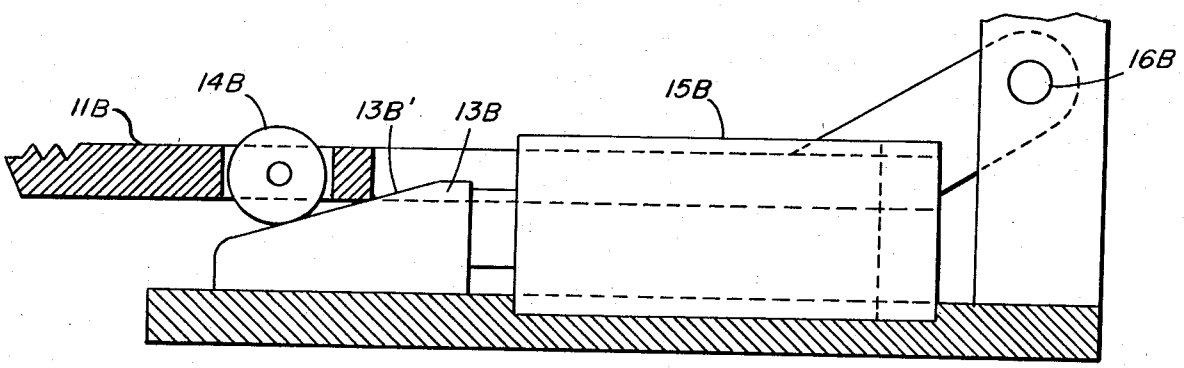
FIG. 10B is a view taken on the line 10B-10B in FIG. 10A looking in the direction of the arrows.

The wedge marked 13B moves to the left in FIGS. 10A and 10B, actuated by an air cylinder 15B, causing a wheel 14B to ride up a ramp 13B' formed by the wedge 13B' and lift plate 11B upwardly, about a pivot 16B, thereby moving the lasting instrumentality 1B (which is mechanically interconnected to the wheel 14B) upwardly. In this way the pads 2A . . . are moved up or down in FIGS. 11A–11C to apply the necessary forces and direction at each stage of the lasting process. Springs 30 (see FIGS. 2, 3 and 10A) serve to press the wheel downward onto the wedge ramp 13B'. Again, the left side of the machine 101 has a similar wedge and ramp arrangement to move the lasting instrumentality 1A up and down during the lasting process.

Figure 6:
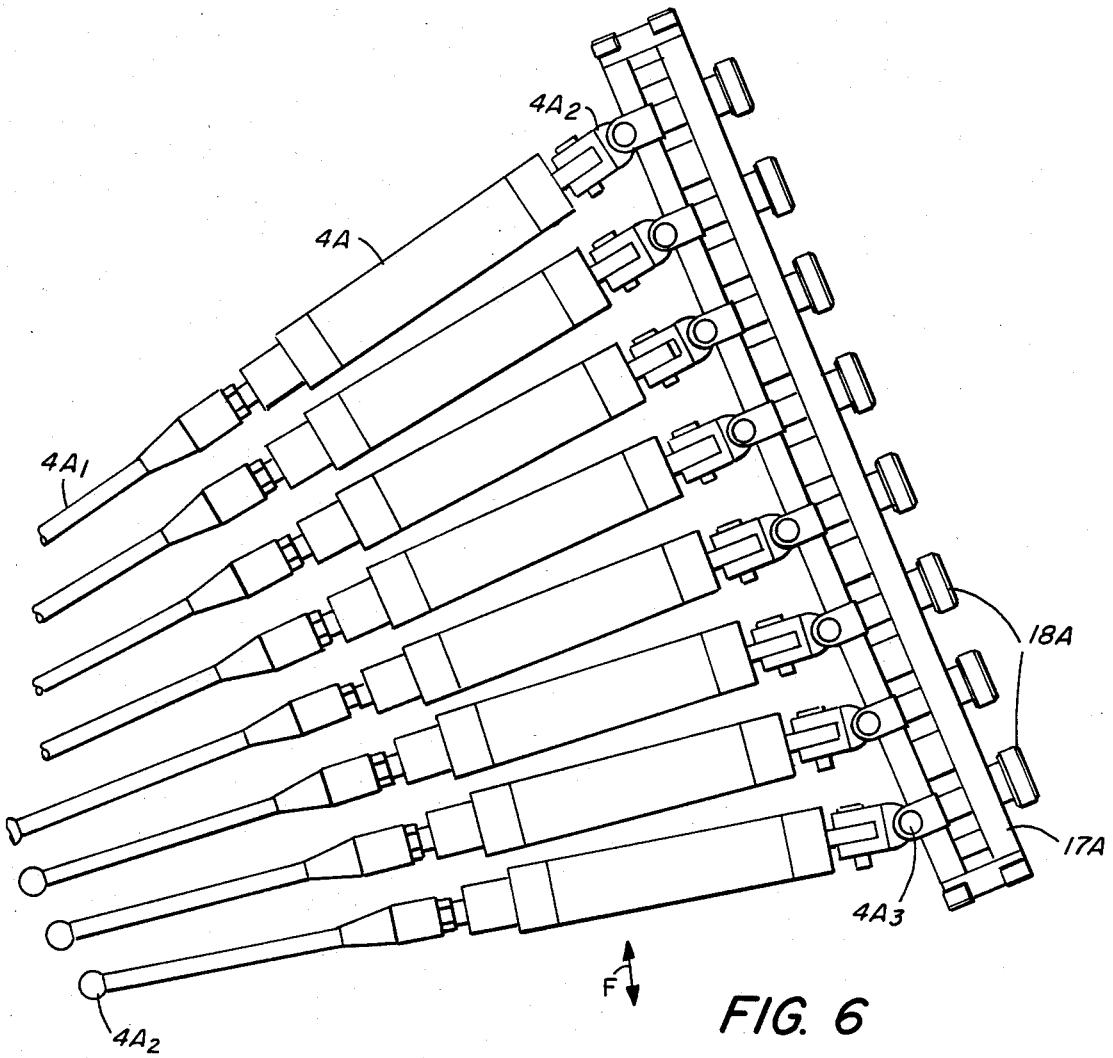
FIG. 6 is a plan view of one set of air-actuated cylinders in FIG. 1 that press an inner lasting pad in FIG. 1 toward the shoe upper.
Figure 9:
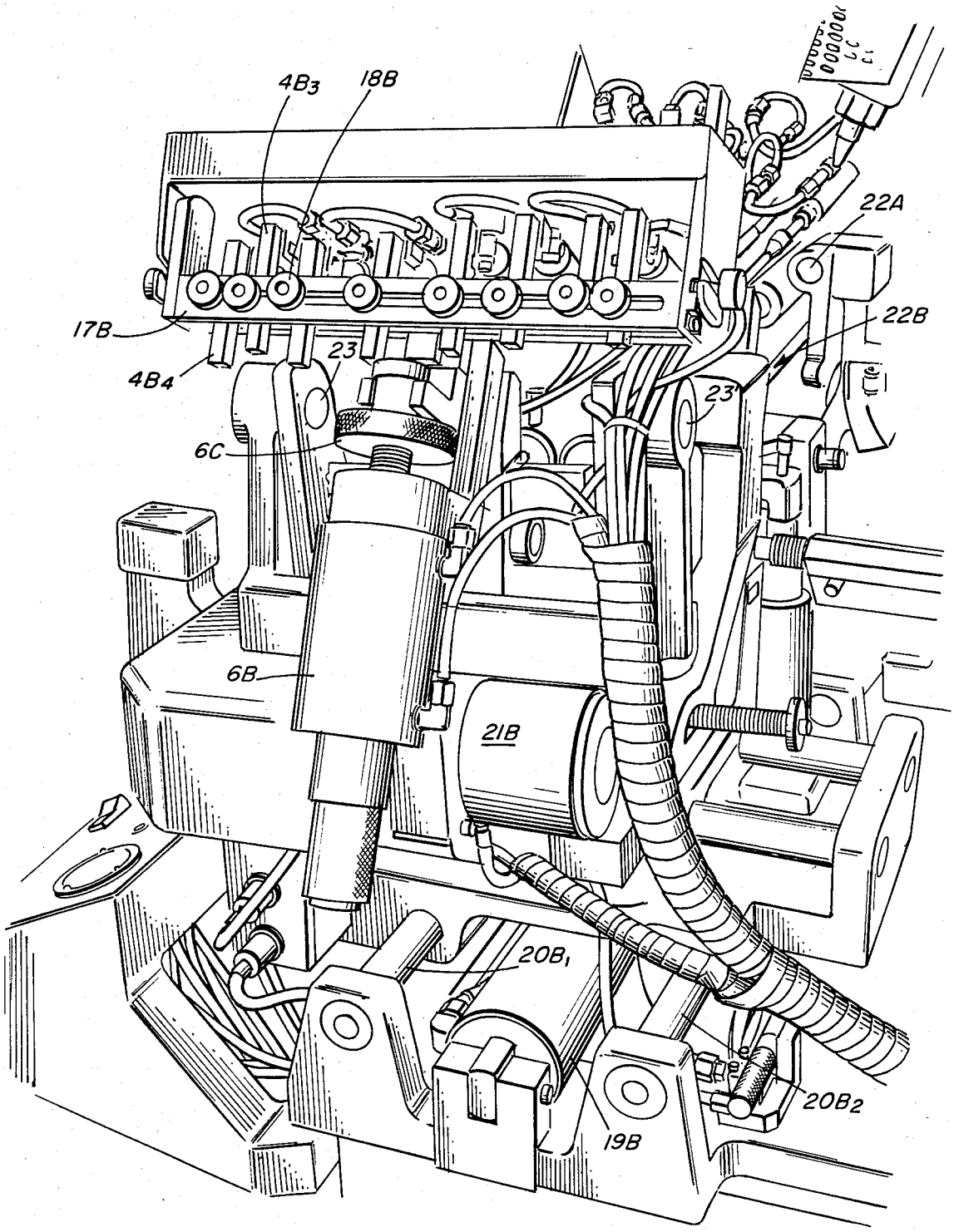
FIG. 9 is an isometric view looking down from the right of the view in FIG. 8 to show the tilting mechanism from a different perspective.

The forward ends of each group of the finger cylinders 4A and 4B engage the corresponding inner lasting pad. The tail ends $4A_3$ (and $4B_3$, as well) of each group of finger cylinders are secured together by a mounting rail 17A in FIG. 6 (and 17B in FIG. 9) which permits adjustment of each cylinder with respect to the footwear assembly so that the axis of each cylinder is oriented substantially perpendicular to the contour of the footwear upper assembly at the region of contact. Adjustment is achieved by loosening nuts 18A in FIG. 6 (18B in FIG. 9) which permits movement of the tail ends in the direction of the arrow shown at F. The tail ends can also be moved into and out of the paper in FIG. 6 when the nuts 18A are loose, i.e., the tail end of each finger cylinder ends in a square cross-section rod $4B_4$ in FIG. 9, which can be moved up and down in the rail 17B when the nuts 18B are loosened, but can be moved to the left and right as well. Again the right side is a mirror image of the left side of the machine 101. The mounting rails 17A and 17B can be manually adjusted up and down to change the small acute angle by adjustment a knob 6C (FIG. 9) that threads along the piston rod of the cylinder 6B; the cylinder 6A has a like adjustment.

Gross position changes of the lasting instrumentalities 1A and 1B are accomplished by an air cylinder 19B (FIG. 9) which moves the pads, etc. toward and away from the upper assembly along ways $20B_1$ and $20B_2$. An electric motor 21B at the right side of the machine 101 permits pivoting (or pitching) of the pads 2B and 3B about a pivot 22B in a rocking motion to raise and lower the forward edges of the pads (a similar motor at the left side pivots the pads 2A and 3A about a pivot 22A). The pitching movement is about an axis substantially horizontal and perpendicular to the pads. This pitch function permits easy adjustment of the pads to accommodate various shoe fashions. An electric motor, similar to the motor 21B, serves to rotate the lasting instrumentality 1B about shafts 23 and 23' in FIG. 9 to revolve the pads about an axis that is substantially horizontal and parallel to the particular pad and hence change the height at which the pads 2B and 3B address the shoe upper (a similar motor at the left of the machine 101 forms a similar function as to the pads 2A and 3A). All these motors have chain drives to achieve their purposes.

Covers 24A and 24B are pivoted respectively counterclockwise and clockwise in FIG. 1 to permit a view of the active machine elements. When the machine is being used these covers pivot down and over the cylinders, tubing, and so forth.

Figure 12:
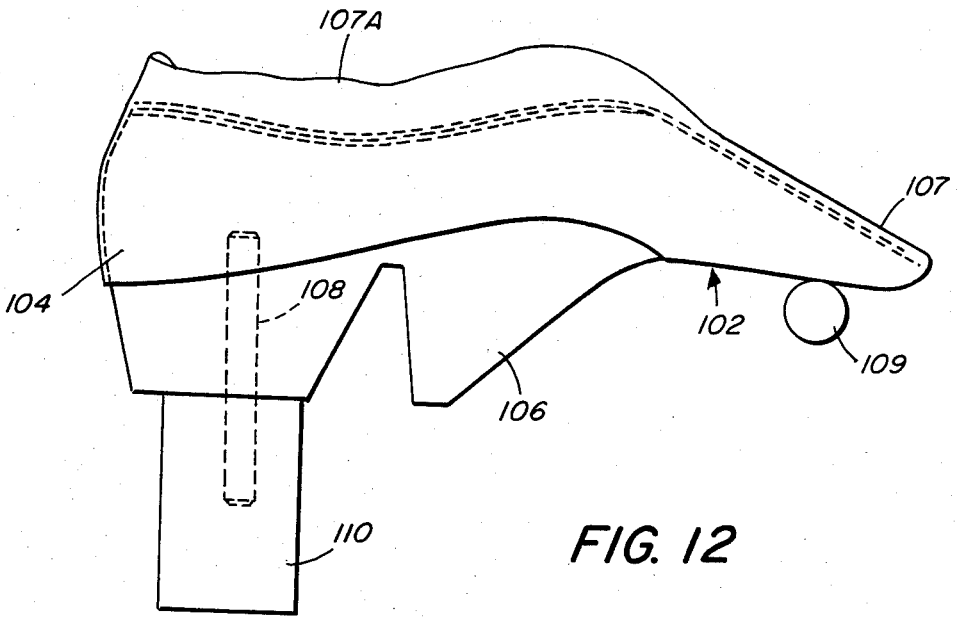
FIG. 12 is a side view of the footwear assembly of FIG. 11.

Control of the various electric motors 21B . . . to achieve pitch functions and the height adjustment functions noted above is achieved through electric switches in control panels 25A and 25B. The electric motor drives perform what heretofore were hand-operated functions and greatly facilitate manipulation of pad orientation with respect to the upper assembly during lasting. The shoe assembly 102 in FIG. 12 is maintained in position during the operations described above by a pin 108 that is rotated clockwise by a spindle 110 to press the toe of the assembly onto a toe rest 109.

Further modifications of the invention herein disclosed will occur to persons skilled in the art and all such modifications are deemed to be within the scope of the invention as defined by the appended claims.

What is claimed is:

1. A machine, operable on a footwear assembly comprising a last having an insole located at its bottom and an upper mounted thereon with the toe portion of the upper margin wiped against and secured to the insole and unwiped portions of the upper extending heelwardly of the wiped margin portion, which unwiped margin portions extend upwardly at an open angle to the insole, for applying adhesive in the region between said unwiped margin portions and the corresponding portions of the insole at said region, said machine comprising:

a footwear assembly support for supporting the footwear assembly with the insole directed upwards;

a pair of nozzles spaced upwardly from and facing said insole and mounted for motion toward and away from the insole as well as transverse and longitudinal movement with respect to the insole, said nozzles being operable to apply adhesive into said region;

a lasting tool operable to clamp the upper tightly against the last and to apply light backup pressure against the unwiped margin to support the same, but nevertheless maintaining the open angle between the unwiped margin portions and the insole to permit application of adhesive into said region, said lasting tool comprising two lasting instrumentalities each comprising an inner lasting pad, one inner lasting pad being disposed at each side of the footwear assembly, each lasting pad being made of an elastic, flexible and deformable material, one end of each inner lasting pad being formed into a plurality of relatively rigid segments;

actuator means to press the rigid segments of the inner lasting pad at each side of the footwear assembly inwardly of the footwear assembly to press the upper tightly against the last and to apply said light backup pressure while maintaining said open angle, which actuator means presents the two inner lasting pads at one level when the adhesive is being applied and, subsequent to application of the adhesive, moves the two lasting instrumentalities to a second level upwardly of said insole while simultaneously moving the relatively rigid segments of the two inner lasting pads inwardly and over the insole in a wiping action to fold the margin onto the insole to press the adhesive between the margin and the insole to adhere the margin onto the insole, part of said actuator means being pivoted during wiping from an orientation at which forces upon the pads are directed at a small acute angle to the footwear assembly bottom to an orientation at which the forces are at a much larger acute angle to the footwear assembly bottom.

2. A machine according to claim 1 in which the two lasting instrumentalities include quick-release means to permit fast removal of the lasting pads and replacement thereof without need to remove any screw-type fasteners.

3. A machine according to claim 2 in which the opposite end of each lasting pad, from said one end, is received by a clamping mechanism which is operated by a cam to clamp and release the inner and outer lasting pads.

4. A machine according to claim 3 in which said opposite end of each lasting pad is formed with its edge folded back and serrated, one serrated edge being received by a similarly serrated part of the clamping mechanism.

5. A machine according to claim 2 in which each rigid segment comprises a metal structure with a clip fastener to receive and hold the actuator means and operable to permit quick release of the actuator means.

6. A machine according to claim 5 in which the actuator means comprises a plurality of fluid-actuated finger cylinders each having a rod with a spheroidal end that is secured by the clip to its associated metal structure and is universally movable with respect thereto, the plurality of fluid actuated finger cylinders being operable, as the associated rigid segment moves upwardly by means of a wedge to force the rigid segment, and hence the unwiped margin, over the inner sole to achieve wiping, each fluid-actuated finger cylinder moving, during wiping, from said small acute angle to said much larger angle.

7. A machine according to claim 6 in which said clip comprises a metal insert having an opening to receive said spheroidal end and a latch to retain the spheroidal end therein, there being a spring to retain the latch in a closed position to maintain the spheroidal end within the clip and an open position which permits release of the spheroidal end.

8. A machine according to claim 6 in which a group of the fluid actuated finger cylinders is associated with each inner lasting pad and in which the tail ends of the plurality fluid-actuated finger cylinders of each group are secured together by a mounting rail which permits adjustment of the orientation of each cylinder with respect to the footwear assembly so that the axis of each cylinder is oriented substantially perpendicular to the contour of the assembly at the region of contact and also the magnitude of said small acute angle.

9. A machine according to claim 8 in which the mounting rail has adjustment means to change the initial magnitude of said small acute angle.

10. A machine according to claim 9 having a further fluid cylinder that engages each mounting rail and serves to move the tail ends of each group of the fluid-actuated finger cylinders upward to pivot each group from said small acute angle to said much larger acute angle during said wiping action.

11. A machine according to claim 1 in which the actuator means includes wedge means to raise each lasting instrumentality to said second level, said wedge means comprising a wedge, a wheel which rolls up a ramp formed by the wedge and an actuator to drive the wedge toward the wheel so that the corresponding lasting instrumentality moves respectively from the first level to the second level during wiping.

12. A machine according to claim 1 in which each lasting instrumentality includes a second lasting pad disposed outwardly of the inner lasting pad, one end of the second lasting pad being formed into a plurality of relatively rigid segments, said actuator means during lasting, serving to press the rigid segments of the second lasting pad of each said lasting instrumentality inwardly against that part of the corresponding inner lasting pad that is just below the rigid segments thereof, to press the upper tightly against the last.

13. A machine according to claim 12 in which the two lasting instrumentalities include quick-release means to permit fast removal of the lasting pads and replacement thereof without need to remove any screw-type fasteners.

14. A machine according to claim 13 in which each of the rigid segments comprise a thickened portion of the pad at said one end of each pad and a metal horseshoe-shaped fastener surrounding the thickened portion.

15. A machine according to claim 1 having electric motor drive means connected to orient and re-orient the pads both in terms of pitch about an axis substantially horizontal and perpendicular to the particular pad and in rotation about an axis substantially horizontal and parallel to the particular pad.

16. A method of lasting a footwear assembly having an insole located at its bottom and an upper mounted thereon with the toe portion of the upper margin wiped against and secured to the insole and unwiped portions of the upper extending heelwardly of the wiped margin portion, which unwiped margin portions extend upwardly at an open angle to the insole, for applying cement in the region between said unwiped margin portions and the corresponding portions of the insole at said region, comprising:

supporting the footwear assembly with the insole directed upwards;

presenting a pair of nozzles spaced outwardly from and facing said insole and mounted for motion toward and away from the insole as well as transverse and longitudinal movement with respect to the insole, said nozzles being operable to apply adhesive into said region;

presenting a lasting tool operable to clamp the upper tightly against the last and to apply light backup pressure against the unwiped margin to support the same, but nevertheless maintaining the open angle between the unwiped margin portions and the insole to permit application of adhesive into said region, said lasting tool comprising two lasting instrumentalities each comprising two inner lasting pads, one inner lasting pad being disposed at each side of the footwear assembly, each lasting pad being made of an elastic, flexible and deformable material, one end of each inner lasting pad being formed into a plurality of rigid segments;

pressing the inner lasting pad at each side of the footwear assembly inwardly of the footwear assembly to press the upper tightly against the last and applying said light backup pressure while maintaining said open angle, the two inner lasting pads being presented at one level when the cement is being applied and, subsequent to application of the cement, moving the two lasting instrumentalities to a second level upwardly of said insole while simultaneously moving the rigid segments of the two inner lasting pads inwardly and over the insole in a wiping action to fold the margin onto the insole to press the adhesive between the margin and the insole to adhere the margin onto the insole, the direction of the inwardly directed pressing forces being changed during wiping from an orientation at which forces upon the pads are directed at a small acute angle to the footwear assembly bottom to an orientation at which the forces are at a much larger acute angle to the footwear assembly bottom.

* * * * *